US005661887A

United States Patent [19]

Byrne et al.

[11] Patent Number: 5,661,887

[45] Date of Patent: Sep. 2, 1997

[54] BLIND RIVET SET VERIFICATION SYSTEM AND METHOD

[75] Inventors: Darren S. Byrne, Naugatuck; Eymard J. Chitty, Trumbull, both of Conn.

[73] Assignee: Emhart Inc., Newark, Del.

[21] Appl. No.: 425,621

[22] Filed: Apr. 20, 1995

[51] Int. Cl.[6] ..... B21J 15/28

[52] U.S. Cl. ..... 29/243.525; 227/2; 72/20.1; 72/21.1

[58] Field of Search ..... 72/20.1, 20.4, 72/21.1, 21.4, 391.4; 227/1–4; 29/243.521, 243.523, 243.524, 243.525

[56] References Cited

U.S. PATENT DOCUMENTS

| | | | |
|---|---|---|---|
| 4,163,311 | 8/1979 | Sigmund . | |
| 4,811,881 | 3/1989 | Heck | 227/4 |
| 4,901,431 | 2/1990 | Gast . | |
| 5,027,631 | 7/1991 | Naito | 72/21.1 |
| 5,035,129 | 7/1991 | Denham et al. | 29/243.523 |
| 5,035,353 | 7/1991 | Smart et al. | 227/3 |
| 5,036,576 | 8/1991 | Gast | 227/2 |
| 5,098,001 | 3/1992 | Smart et al. | 227/51 |
| 5,125,151 | 6/1992 | Smart | 227/2 |
| 5,323,946 | 6/1994 | O'Connor et al. | 227/2 |

FOREIGN PATENT DOCUMENTS

| | | | |
|---|---|---|---|
| 454890 | 11/1991 | European Pat. Off. . | |
| 462707 | 12/1991 | European Pat. Off. . | |
| 572819 | 12/1993 | European Pat. Off. . | |
| 4217901 | 12/1993 | Germany | 29/243.523 |
| 4401134 | 7/1995 | Germany . | |
| 4429225 | 2/1996 | Germany . | |

*Primary Examiner*—David Jones
*Attorney, Agent, or Firm*—E. D. Murphy

[57] ABSTRACT

A blind rivet set verification system for setting a blind rivet assessing the acceptability of the rivet set. The system includes a remote intensified rivet setting tool and computer hardware and software. The tool comprises a displacement transducer that produces a displacement signal and a pressure transducer that produces a pressure signal. The transducers are connected to the computer which receives the distinct signals. These signals are interpreted to plot a displacement-versus pressure waveform and to determine the velocity of the movement of an air piston that responds to the rivet set by hydraulic pressure. Using the combined date of the velocity waveform and the displacement-versus pressure waveform, the breakload is identified and compared against predetermined ideal data to assess the acceptability of the set. The displacement reading at break is corrected for jaw slippage and offset of the air piston.

37 Claims, 10 Drawing Sheets

BLIND RIVET SET VERIFICATION SYSTEM AND METHOD

BACKGROUND OF THE INVENTION

1. Technical Field

This invention relates to the setting of blind rivets. More particularly, this invention relates to a blind rivet setting system in which a blind rivet is first set and then the correctness of the set of the rivet is verified.

2. Discussion

Rivets are widely used to firmly fasten together two or more components of little susceptibility to loosening and thus to produce a tight joint at a low cost.

The setting of the common rivet is accomplished when one end of the rivet is mechanically deformed to create a second head. The blind rivet is a special class of rivet that can be set without the need for mechanical deformation by a separate tool to create the second head. Special blind rivet setting tools are used for setting these types of rivets. Examples of setting tools may be found in U.S. Pat. No. 3,713,321 issued on Jan. 30, 1973 to Gabriel for RIVET GUN, U.S. Pat. No. 3,828,603 issued on Aug. 13, 1974 to (Scheffield) et al. for riveting apparatus, and U.S. Pat. No. 4,263,801 issued on Apr. 28, 1981 to Gregory for HYDRAULIC RIVETER. These tools provide various approaches to setting rivets including setting by hydraulic and pneumatic power. A relatively sophisticated version of a blind rivet setting tool is disclosed in U.S. Pat. No. 4,744,238 issued on May 17, 1988 to Halbert for PNEUMATIC RIVET SETTING TOOL. This setting tool includes a rivet feed mechanism, a rivet magazine and sequencing controls providing cycle-through operation that utilizes pneumatic logic control. A self-diagnosing blind rivet tool is disclosed in U.S. Pat. No. 4,754,643 issued on Jul. 5, 1988 to Weeks, Jr. et al. for METHOD AND APPARATUS FOR AUTOMATICALLY INSTALLING MANDREL RIVETS. This patent is directed to an automated and semi-automated rivet installation system that has the ability to diagnose selected tool conditions and to convey information on the conditions to the operator. Monitored conditions include the rivet placement within the tool, mechanism positions, and air pressure conditions.

One common shortcoming of prior art apparatus for the installation of blind rivets is the inability of the operator to gauge the correctness of the rivet set which cannot be readily determined by observation or touch. This is because the second head is created on the far side (or the blind side) of the elements being riveted. In response to this need, it has been suggested that an electroacoustic transducer be used to convert the mechanical braking of the mandrel at the conclusion of the setting process to an electric signal for determination of the correctness of the set. It has been further suggested that a strain gauge be employed to sense the setting force of the rivet. These methods, however, provide the operator with limited set condition information. Consequently, the set condition of the rivet is assessible only in a marginal way.

Accordingly, there is still a need for a system by which a blind rivet may be first set and then the correctness of the set fully and reliable verified.

SUMMARY OF THE INVENTION

It is therefore an object of the present invention to overcome the disadvantages associated with known blind rivet setting tools by providing an improved rivet setting and correctness verification system.

It is a further object of the present invention to provide a system which measures the pressure of hydraulic fluid acting on a rivet mandrel required to set a rivet.

Yet a further object Of the present invention is to provide such a system which measures the displacement of a fluid-moving piston through a rivet setting cycle.

Still another object of the present invention is to provide such a system in which the pressure measurement and displacement are assimilated to produce a pressure-versus-displacement waveform.

A further object of the present invention is to provide a set verification system according to the present invention in which a velocity waveform is calculated based upon mandrel displacement over time.

Yet still a further object of the present invention is to obtain several rivet standards by examining the various peaks and valleys present in the pressure-versus-displacement waveform and the velocity waveform and comparing these standards against predetermined ideal values to assess the set.

The present invention achieves these and other objectives in an improved blind rivet set verification system that comprises a blind rivet setting apparatus and a programmed system control circuit.

The apparatus includes a rivet mandrel pulling head connected by a hydraulic line to an intensifier. The intensifier includes an air cylinder housing a movable air piston. A pressure transducer is connected with a fluid line provided between the intensifier and the pulling head. A displacement transducer is operatively connected to the air piston.

Each of the pressure and displacement transducers is connected to a signal amplifier. The amplified signals are provided to an analog-to-digital converter in a computer. The computer reads the signal of each transducer sequentially during the setting cycle. Both a pressure-versus-displacement waveform as well as a velocity waveform are produced from the signals.

The computer reads the various peaks and valleys of the waveforms and undertakes several analyses including breakload, clamp, entry load and pull-through. An additional analysis, undergrip-overgrip analysis, may be made and includes compensation for two factors, jaw slippage and offset of the air piston.

BRIEF DESCRIPTION OF THE DRAWINGS

Additional objects and advantages of the present invention will become apparent from a reading of the following detailed description of the preferred embodiment which makes reference to the drawings of which.

DETAILED DESCRIPTION OF THE PREFERRED EMBODIMENT

Figure 1:
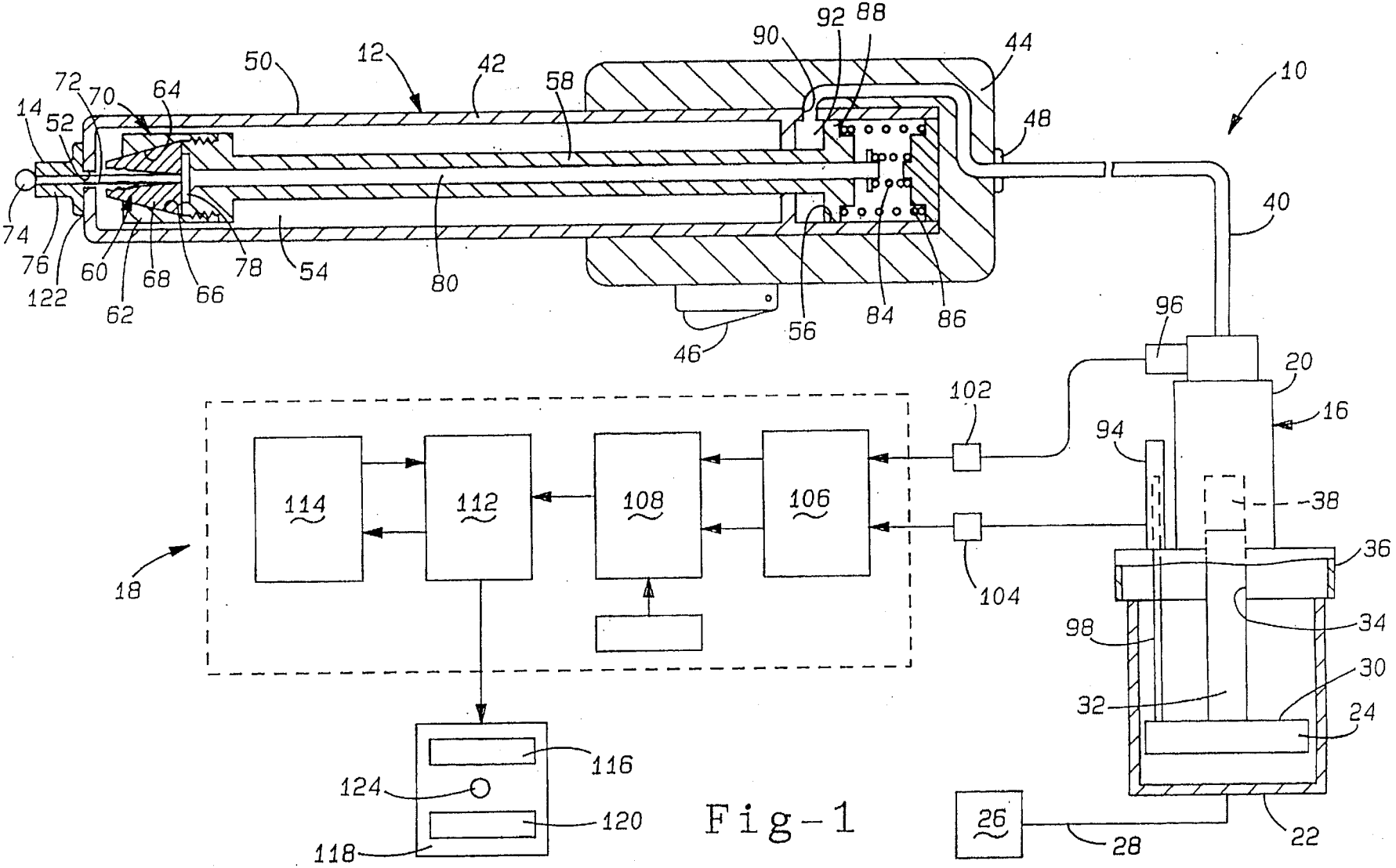
FIG. 1 is a combined pictorial and block diagram of the blind rivet setting apparatus according to the present invention showing the setting tool and intensifier components in partial cross-section.

Reference is first made to FIG. 1 wherein the system for setting blind rivets and for verifying the acceptability of their set according to the present invention is generally illustrated as 10. The system 10 includes a rivet mandrel pulling tool 12 for setting a blind rivet 14, a remote intensifier 16, and a system control circuit 18.

The intensifier 16 includes an oil cylinder 20 and an air cylinder 22. The air cylinder 22 includes a piston 24 that reciprocates within the cylinder 22 in response to pressure created by a pressure source 26. The pressure source 26 is fluidly connected to the cylinder 22 by a fluid line 28. Pressure is conventionally provided to the air cylinder 22 between 80–85 p.s.i. While it is possible to integrate the intensifier 16 with the tool 12 itself, this is not a desirable approach in that electrical wiring connecting the tool 12 and the intensifier 16 would be required and thus susceptible to failure. In addition, the remoteness of the intensifier virtually eliminates tool access problems. It is accordingly preferred that the intensifier 16 be remotely situated from the tool 12 as illustrated.

The piston 24 includes a substantially planar top side 30 to which is connected a reciprocating shaft 32. The shaft 32 is positioned through an arm passing aperture 34 defined in a cylinder end cap 36. The free end of the shaft 32 terminates in an oil cavity 38 defined in the oil cylinder 20. Pneumatic oil is provided within the cavity 38.

The fluid of the oil cavity 38 is continuous with the rivet mandrel pulling tool 12 through a flexible hydraulic hose 40. The tool 12 comprises an elongated body generally illustrated as 42. While the body 42 may be of any of several constructions, it is preferably provided with a handle 44 as shown. A trigger 46 which actuates the tool 12 is fitted in the handle 44 in a conventional manner and is operatively associated with a valve 48.

The elongated body 42 includes an elongated housing 50. The housing 50 includes a mandrel-passing aperture 52 defined in its fore end. While not limited to this construction, the housing 50, as illustrated, is subdivided internally into a fore chamber 54 and a hydraulic cylinder chamber 56. The elongated body 42 includes an axially movable pulling shaft 58 provided along its long axis. It must be understood that the construction of the housing 50 may be varied in many ways, with its only essential feature being that it provide support for the pulling shaft 58 and for a means of axially moving the shaft.

A jaw assembly 60 is operatively associated with the fore end of the pulling shaft 58. The jaw assembly 60 includes a jaw cage 62 having an internal beveled wedging surface 64 that defines an internal bore 66. An array of split jaws 68 are movably provided within the cage 62. When the outer surfaces of the split jaws 68 act against the beveled surface 64, the jaws 68 engage and grip an elongated stem 70 of a mandrel 72 of the blind rivet 14. The mandrel 72 also includes a rivet head 74. The mandrel 72 comprises the head deforming component of the rivet 14 as is known in the art. The rivet 14 includes a tubular deformable sleeve 76. A variety of methods may be employed to manipulate the jaw assembly 60 to grasp and hold the stem 70 of the mandrel 72. While one such method is discussed-hereafter, the various methods of construction of rivet setting tools are well known to those skilled in the art, and it is accordingly to be understood that the following construction is only illustrative and is not intended to be limiting.

According to the illustrated construction of the present invention, a pusher 78 is fixed to the forward end of a pusher rod 80. The pusher rod 80 is provided within a central throughbore defined in the pulling shaft 82. The pusher rod 80 is axially movable within this throughbore and is biased at its aft end against the back wall of the hydraulic cylinder chamber 56 by a spring 84. A weaker spring 86 acts between the same wall and the aft end of the pulling shaft 58.

A piston 88 is fixed to the pulling shaft 58 and is capable of axial motion in both fore and aft directions within the hydraulic cylinder chamber 56. The pressure source 26 forces a pressurized fluid (not shown) through the fluid line 28 into the cylinder chamber 56 on the forward side of the piston 88 through a pressurized fluid port 90 into a pressurizable side 92 of the hydraulic cylinder chamber 56. By introducing a pressurized fluid into the fluid-tight chamber defined within the pressurizable side 92, the piston 88 is forced to move aftward causing the stem 70 to break from the head 74 as described below.

The tool 12 is fluidly connected with the remote intensifier 16 through the flexible hose 40. Provided in operative association with the intensifier 16 are transducers to measure hydraulic fluid pressure and axial displacement of the movable components of the cylinders 20 and 22. These transducers include a linear encoder 94 and a pressure transducer 96.

The linear encoder 94 (an analog voltage-output displacement transducer or other suitable displacement measuring device such as a linear differential transformer) is provided in operative association with the air piston 24 through a movable rod 98 fixed to the side 30 of the piston 24. The rod 98 moves axially with the piston 24. The encoder 94 produces an output signal (S) related to the linear displacement of the piston 24. Specific placement of the transducer 94 as shown in FIG. 1 is only illustrative, and this component may be placed elsewhere on the cylinders 20 and 22, provided that it is in operative association with either the piston 24 or the shaft 32.

The pressure transducer 96 is in fluid communication with the hydraulic oil and hence is provided between the oil cavity 38 and the tool 12. The transducer 96 may be selected from a variety of types and is adapted to sense the amount of hydraulic pressure applied to the pulling head 12 during the rivet setting process and produce an output signal (P) related to this pressure.

The system control circuit 18 includes signal conditioning circuits 102 and 104 which receive outputs transmitted from the pressure transducer 96 and the linear encoder 94 respectively. The pressure (P) and displacement (S) signals, converted from their analog form to a digital form in the signal conditioning circuit 102 and 104, are supplied through an amplifier 106 to an integrator circuit 108 which monitors the sensed signals throughout the riveting cycle. The integrator circuit 108 reads the pressure (P) and displacement (S) signals sequentially during the setting cycle, sampling each transducer circuit in 1 millisecond increments over a total time of one second.

Figure 2:
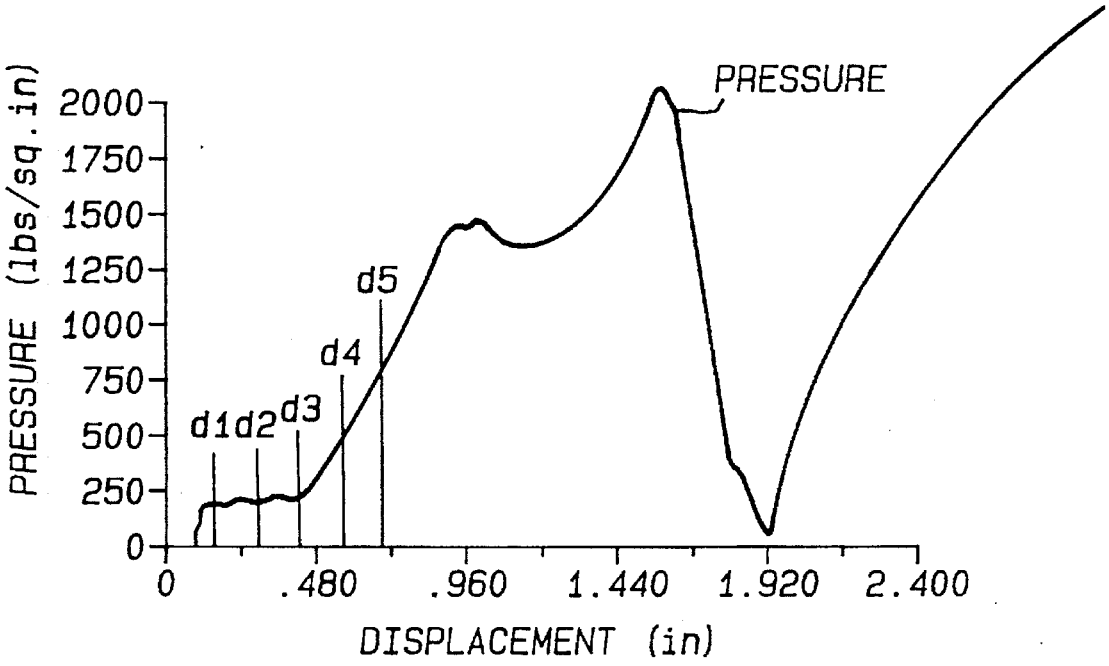
FIG. 2 shows a coordinate graph illustrating a pressure-versus-displacement waveform for a blind rivet being set with displacement measured along the X-axis and pressure measured along the Y-axis.
Figure 3:
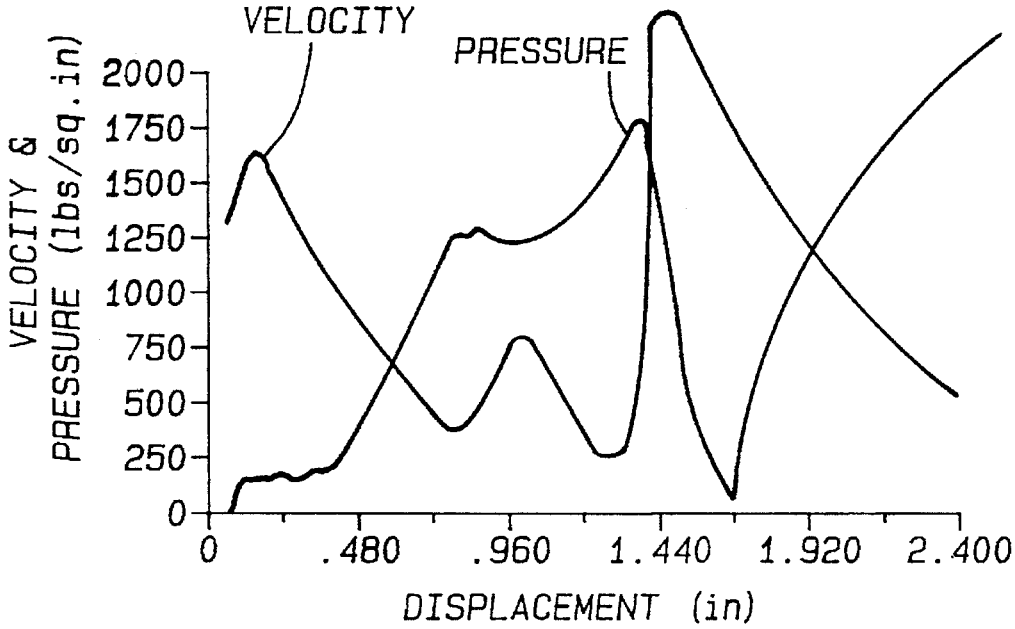
FIG. 3 shows a coordinate graph similar to that shown in FIG. 2 but having an additional velocity waveform superimposed on the pressure-versus-displacement waveform.

The integrator circuit 108 uses this data to develop selected waveforms. One of these waveforms, shown graphically in FIG. 2, is a pressure-versus-displacement waveform with displacement (measured in inches) measured along the X-axis and pressure (measured in pounds per square inches) and load (measured in pounds) measured along the Y-axis. The integrator 108 also reads displacement signals over increments of time to develop a velocity waveform. A timer 110 is integrated with the circuit 108. The velocity waveform is shown in FIG. 3 superimposed on a pressure-versus-displacement waveform. Because both displacement and time are known, velocity can be calculated as follows:

$$v1 = \frac{d2 - d1}{t2 - t1} \text{ and } v2 = \frac{d3 - d2}{t3 - t2} \text{ and } vx = \frac{d(x+1) - d(x)}{t(x+1) - t(x)}$$

where $v$ = velocity, $d$ = displacement,
$t$ = time, $x$ = memory location
(note: $t(x+1) - t(x)$ always equals $2mS$, $1mS$ sampling rate per transducer)

As one would expect, and as illustrated in FIG. 3, the velocity of the air piston rises as the pressure falls. The reverse is also true, and, again, this may be understood by reference to FIG. 3.

The integrator circuit 108 analyzes each waveform and produces output signals representative of predetermined characteristics of the observed waveforms (including, for example, particular peaks and valleys). These output signals are supplied to a comparator circuit 112 which compares the observed waveform characteristics with the corresponding characteristics of an experimentally-derived waveform stored in a programmed reference 114 for the setting of the particular rivet involved. If the actual observed characteristics of the set are within predefined acceptable set ranges of the prestored values, a green light 116 on a visual display 118 is illuminated. If on the other hand the actual observed characteristics of the set are outside the prescribed set value ranges, a red light 120 is illuminated. A graph, such as a correct-versus-incorrect set graph, may be produced in lieu of the single green light-red light combination. The form of the output would depend on the needs of the particular application. (As an alternative to the described construction, the circuit 112 may comprise software to control the functioning of the hardware and to direct its operation.)

A variety of analyses can be performed using the present invention to determine the correctness of the set, with the more significant ones set forth below. While the set verification operations that follow are discussed individually on an analysis-by-analysis basis, this is done for the sake of clarity, and it is preferred that all of them be made for each rivet set using the same set of collected pressure and displacement data.

BREAKLOAD ANALYSIS

The name "blind rivet" is derived from the fact that such rivets are installed from only one side on an application, the primary side. The blind rivet 14 includes the tubular rivet sleeve 76 having a flange 122 at the aft end of the sleeve 76. In the illustrated initial cycle position, the head 74 remains adjacent the forward end of the sleeve 76.

When a rivet is set in the workpiece (not shown), the mandrel 72 is held between the split jaws 150 and is pulled by the setting tool. As the pulling shaft 58 is forced aftward by fluid pressure against the resistance of the weaker spring 86, the pusher rod 80, biased against the stronger spring 84, resists aftward movement, causing the pusher 78 to act against the aft sides of the split jaws 68. The outer surfaces of the split jaws 68 act against the internal beveled wedging surface 64 to grip the stem 70. Once the stem 70 is gripped and the split jaws 68 are fully lodged between the surface 64 and the stem 70, the pusher rod 80 moves aftward with the pulling shaft 58, the biasing force of the stronger spring 84 now overcome.

As the jaw assembly 60 is carried aftward by movement of the pulling shaft 58, the head 74 of the rivet 14 enters the sleeve 76. This is denoted the "entry point", and is the point at which the sleeve 76 begins to deform. As the mandrel 72 continues to be pulled, the rivet sleeve 76 is deformed up to the secondary side of the workpiece. The deformed part of the sleeve 76 acts as the secondary clamp element, whereas the flange 122 becomes the primary clamp element. It is the combination of the secondary and primary clamp elements that holds two or more parts of an application together.

Continued aftward movement of the jaw assembly 60 by movement of the pulling shaft 58 pulls the head 74 into the sleeve 76 causing its maximum deformation. Once the head 74 reaches the secondary side, the mandrel 72 breaks off from the head 74 at its crimp, this representing the breakload, and the secondary clamp element is created by the combination of the now-unattached head 74 and the sleeve 76.

When fluid pressure within the side 92 is released, both the pulling shaft 58 and the pusher rod 80 are restored to their preengaged positions by the biasing forces of the springs 84 and 86. With the force on the jaws 68 removed, the jaws 68 are relaxed to their preengaged positions and the stem 70 is released and discarded. The tool 12 is then ready to repeat its cycle.

Breakload relates to the breaking of the stem from the head of the rivet. If the breakload is either too great or too small, according to upper and lower predetermined desired specifications for the particular rivet and stored in the programmable reference, the set is rejected.

Figure 4:
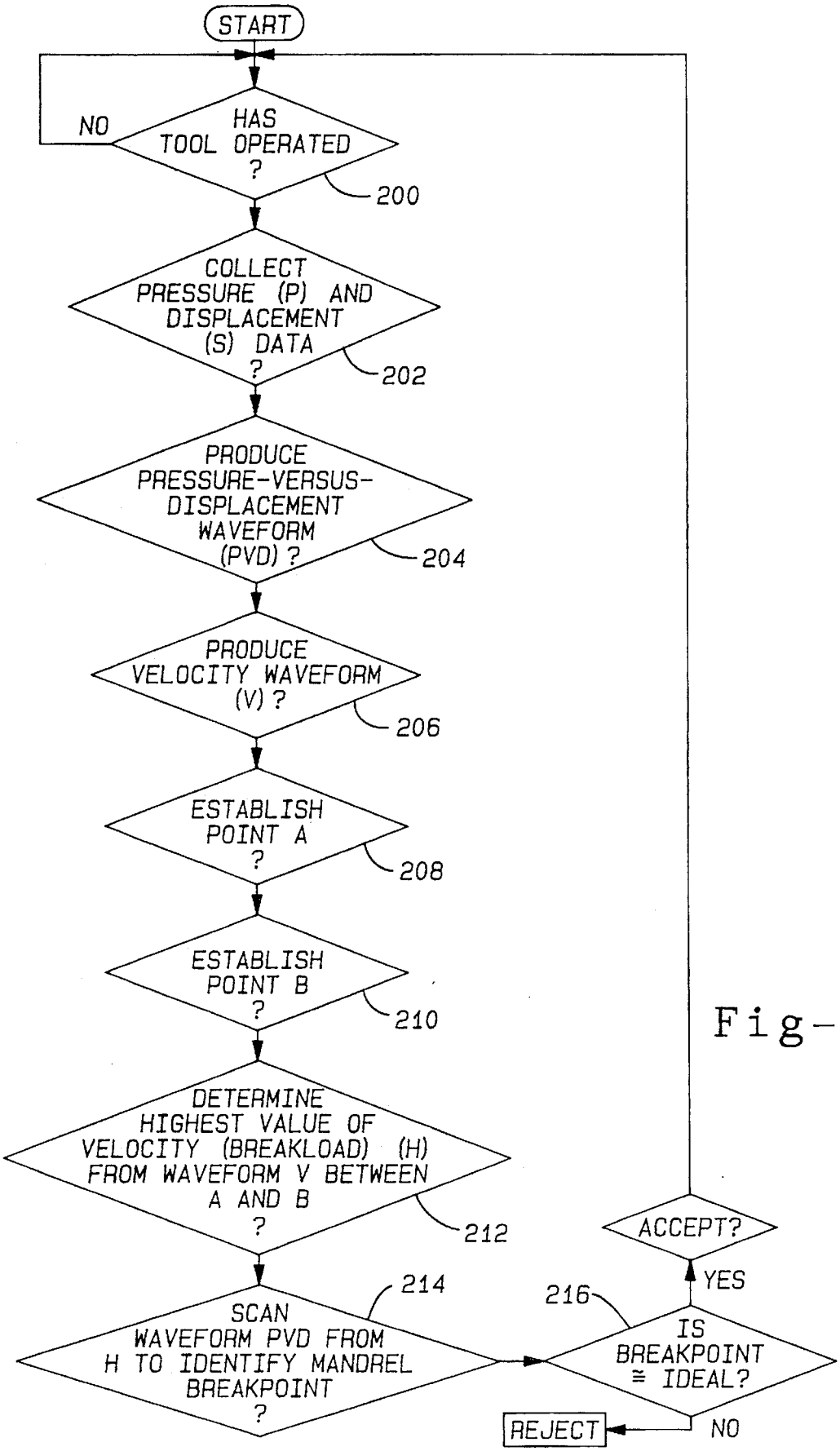
FIG. 4 is a control flowchart of illustrative breakload analysis steps in accordance with this invention.

The system control circuit 18 includes a programmed control algorithm to analyze the breakload. The control algorithm used to analyze breakload is described by reference to a breakload analysis flow chart shown in FIG. 4 in which an exemplary operation flow of the analysis is set forth.

Operation of the tool 12 is initiated via actuation of the trigger 46. The control algorithm makes an initial query at Step 200 as to whether or not the tool has, in fact, been operated. When it is found that the tool has not been operated, the cycle is reset to the initial query until there is verification that the tool has been operated.

Once operation of the tool 12 is verified, the algorithm collects the pressure (P) and displacement (S) data at Step 202 and produces a pressure-versus-displacement waveform (PVD) at Step 204 and, by timing displacement, produces a velocity waveform (V) at Step 206.

Figure 5:
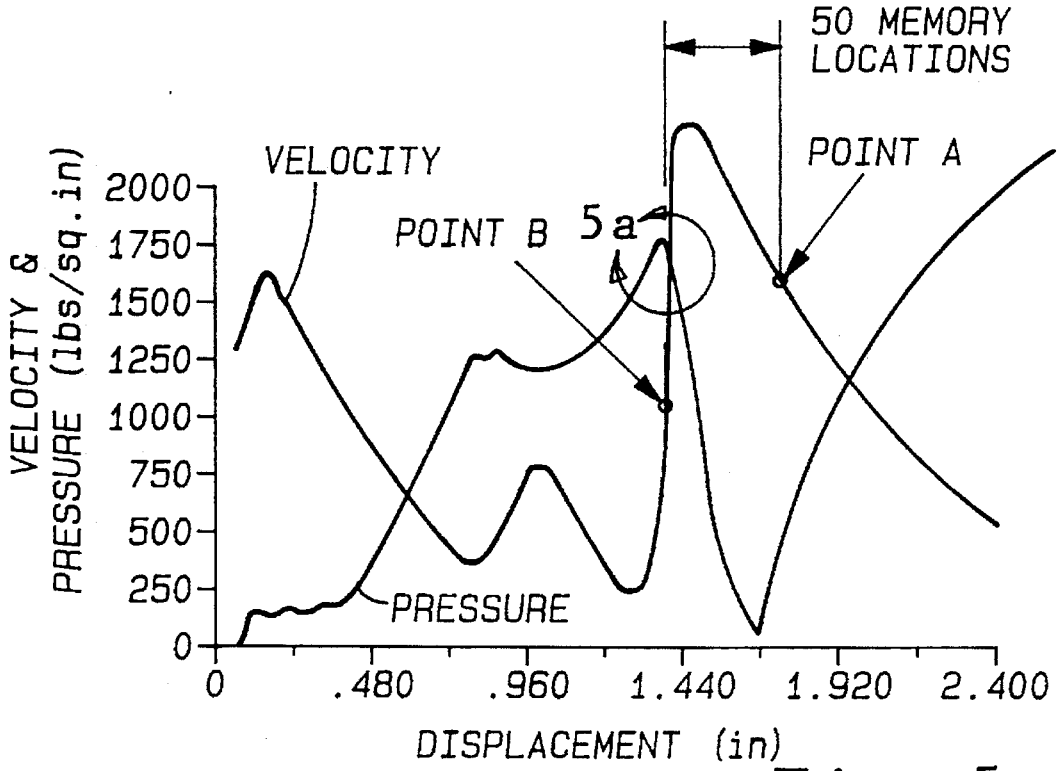
FIG. 5 shows the coordinate graph of FIG. 3 but illustrating specific points identified in making a breakload analysis.
Figure 5A:
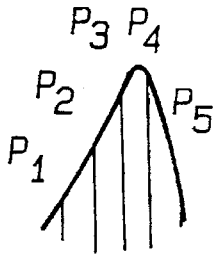
FIG. 5*a* is an enlarged region of FIG. 5 illustrating the breakload peak.

As is known and as is demonstrated in FIG. 5 which shows the coordinate graph of FIG. 3 but which illustrates particular points identified in making a breakload analysis, the highest point on the pressure-versus-displacement waveform occurs immediately after the break of the mandrel stem from the head, this point usually occurring at a mandrel velocity greater than 10 inches per second. Just to the right of this point the air piston 24 reaches the end of its stroke thus causing the velocity to fall to a minimum, as illustrated in FIG. 5. The algorithm then moves to Step 208 where the integrator circuit 108 searches for a point on the velocity waveform having a quickly moving displacement, such as greater than 5 inches per second. This point is identified as Point A on the graph of FIG. 5. With Point A established, the algorithm proceeds to Step 210 where the integrator circuit 108 refers a certain number of memory locations back along the velocity waveform to establish a second point, Point B. In this example, Point B is approximately 50 memory locations preceding Point A. The reason for referring back a certain number of memory locations is to ensure the establishment of Point B at a point on the graph prior to the setting of the rivet.

With Points A and B established, the algorithm then moves to Step 212 in which the integrator circuit 108 searches every location between Point B on the left and Point A on the right for the greatest velocity value. Once this location is identified, the algorithm proceeds to Step 214, and the point identified as the greatest velocity value becomes the reference to begin looking for the breakpoint on the pressure-versus-displacement waveform. The breakpoint is identified by looking for a sudden drop in the pressure value. This is accomplished by comparing each point on the pressure-versus-displacement waveform to the next pressure sample and determining the total difference between the two values. When a drop in pressure greater than a predetermined amount is identified, this location is the breakpoint. Thereafter, the pressure at the breakpoint is converted to a breakload value (in pounds or grams) by multiplying the pressure (in pounds per square inch or grams per square centimeter) by the area of the piston (in square inches or in square centimeters).

The algorithm then moves to Step 216 to compare the breakload value with upper and lower specifications of the rivet. If at Step 216 it is determined that the breakload value is not within the predetermined range, the set is rejected and the red light 120 is illuminated indicating to the operator that the set is unacceptable. Conversely, if the breakload valve is within the predetermined range, the set is accepted and the green light 116 is illuminated and the algorithm returns to start to await the next cycle.

UNDERGRIP-OVERGRIP ANALYSIS

Because the pressure transducer 96 and the displacement transducer 94 are monitored by the integrator circuit 108 sequentially, the location in the memory of the circuit 108 adjacent to the pressure peak at the breakpoint established in the breakload analysis will be the total displacement of the piston 24 at the breakpoint. This is illustrated in the following memory map:

| | | |
|---|---|---|
| loc x | Pressure | Samples taken |
| loc x + 1 | Displacement | at 1 mS intervals |
| loc x + 2 | Pressure | |
| loc x + 3 | Displacement | |
| loc x + 4 | Pressure | |
| loc x + 5 | Displacement | |
| loc x + 6 | Pressure | |

The value of total piston displacement at breakpoint can be compared by the comparator circuit 112 to known upper and lower values stored in the programmable reference 114. If the axial movement of the air piston 24 is within an acceptable range, the operator is so notified by correct signal shown as the illumination of the green light 116 provided on the display 118.

Figure 6A:
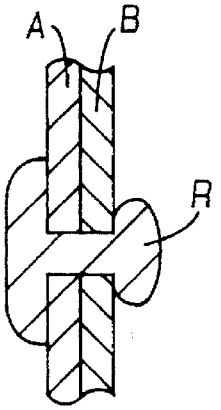
FIG. 6*a* is a sectional view of a workpiece comprising two plates held together by a rivet set at a correct grip.
Figure 6B:
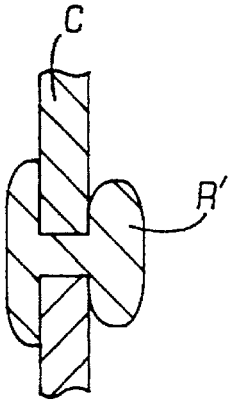
FIG. 6*b* is a sectional view of a workpiece comprising a single plate with a rivet set at an incorrect undergrip.

A rivet set having a correct grip is demonstrated in FIG. 6*a* which shows a sectional view of a workpiece comprising two plates A and B held together by a rivet R. If the axial movement of the air piston 24 is, in fact, too large, an undergrip situation results, because the air piston 24 moved too far at rivet set. The resulting set is graphically illustrated in FIG. 6*b* which is a sectional view of a workpiece comprising (for illustrative purposes) a single plate C and a rivet R' with the rivet set at an incorrect undergrip. As illustrated, the secondary head is formed with an excessive amount of deformed tubular material.

Figure 6C:
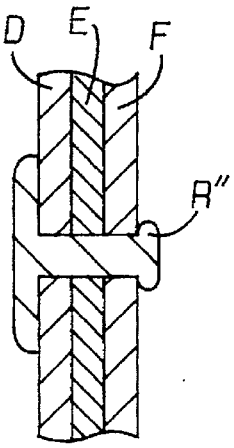
FIG. 6*c* is a sectional view of a workpiece comprising three plates held together by a rivet set at an incorrect overgrip.

If the value of the displacement at the breakpoint is, in fact, too small, then an overgrip situation is indicated resulting from the fact that the air piston 24 did not move far enough at rivet set. The result of the overgrip situation is graphically illustrated in FIG. 6*c* which shows a sectional view of a workpiece comprising three plates D, E and F held together by a rivet R".

Determining the correctness of the grip so as to distinguish between a correct set, an undergrip situation and an overgrip situation, it is necessary to have an accurate displacement reading at breakpoint. However, the accuracy of the value assigned to piston displacement is dependent on two factors that have to be considered: Slippage of the mandrel-holding jaw and offset of the air piston.

Figure 7:
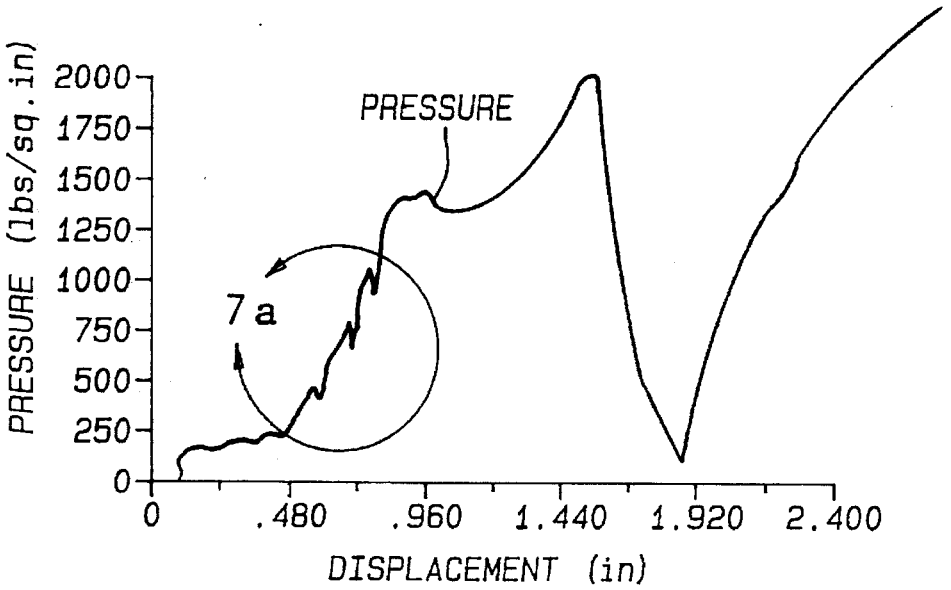
FIG. 7 shows a coordinate graph illustrating a pressure-versus-displacement waveform for a blind rivet being set by a tool experiencing jaw slippage with displacement being measured along the X-axis and pressure measured along the Y-axis.
Figure 7A:
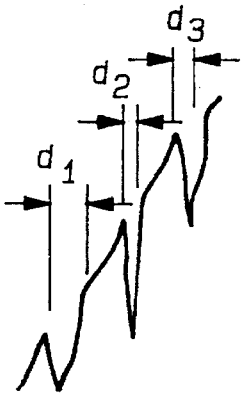
FIG. 7*a* is an enlarged region of FIG. 7 graphically illustrating jaw slippage.

With respect to jaw slippage, this phenomenon occurs generally when the jaws in the pulling head of the tool 12 become dirty or worn, or if the mandrel material is too hard, thus causing the jaws to lose their grip on the mandrel as they are pulled back to set the rivet. When jaw slippage occurs, the hydraulic pressure drops slightly until the jaws regrip the mandrel. FIG. 7 illustrates a pressure-versus-displacement waveform for a blind rivet being set by a tool experiencing jaw slippage. The jagged appearance of the waveform, as seen more clearly in FIG. 7*a* which is an enlarged region of FIG. 7, graphically demonstrates how the tool experiences slippage and then repeatedly attempts to regrip the mandrel. Of course, as may be understood by reference to the graph, jaw slippage will affect overall displacement at the breakpoint.

The present invention provides a method by which accurate displacement values are determined in spite of the phenomenon of jaw slippage. Specifically, because jaw slippage affects the total displacement of the air piston at the breakpoint, the pressure-versus-displacement waveform is monitored and displacement that occurs below 300 pounds per square inch is ignored. This allows time for the jaws to position and grip themselves onto the mandrel body. Each time the jaws experience slippage, the pressure drops, and the displacement is noted. When the jaws regrip the mandrel and the pressure again begins to rise, the displacement reading is again noted. The difference between the two readings is calculated and subtracted from the overall displacement at break, thereby compensating for slippage. The entire pressure-versus-displacement waveform is searched by the integrator 108 for jaw slippage and each time any slippage is found the compensating procedure is repeated. (It is likely that once the jaws slip a first time there will be evidence of additional slippage throughout the waveform.)

In addition to compensating for the slippage to produce accurate displacement values, the operator can also be notified by the circuit 18 that, in fact, slippage has occurred through a slippage warning light 124 on the display 118. Illumination of the light 124 will alert the operator that tool maintenance is required. This can prove a useful preventive maintenance procedure in that as early stages of jaw slippage do not substantially affect tool efficiency, more severe slippage requires multiple tool cycles to set each rivet, thus wasting both time and energy.

Figure 8:
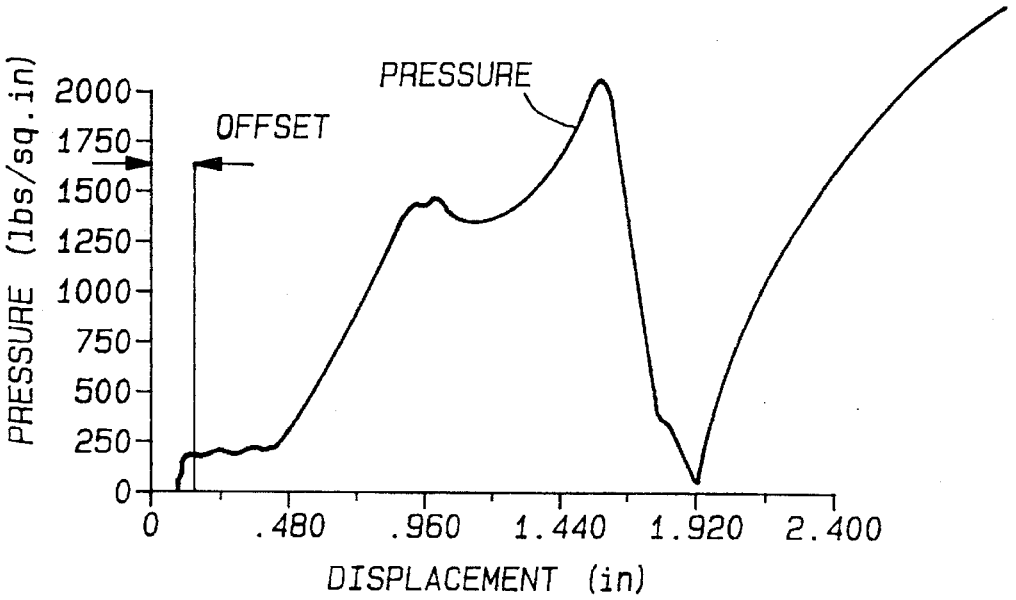
FIG. 8 shows a coordinate graph illustrating a pressure-versus-displacement waveform for a blind rivet being set by a tool experiencing air piston offset with displacement being measured along the X-axis and pressure measured along the Y-axis.

Another factor that must be considered to achieve a correct displacement reading at breakpoint is the effect of offset of the air piston 24 on the pressure-versus-displacement waveform. FIG. 8 illustrates the effect of offset due to a lowering of hydraulic pressure on the pressure-versus-displacement waveform.

In use, an operator may set up to 30 rivets per minute. Because of the relatively high frequency of rivet sets, it is known that the air piston 24 may not fully return to the home position before the next cycle begins. This offset of the air piston 24 has to be considered when determining the total displacement of the air piston 24 at the breakpoint. To determine and therefore compensate for this offset, the amount of piston displacement at the start of the rivet setting process (relative to a predetermined starting position) is noted by the integrator circuit 108 based on signals generated by the displacement transducer 94. This value is then subtracted from the total displacement observed at the breakpoint to achieve the true displacement during the rivet setting process, thus compensating for offset.

Figure 9A:
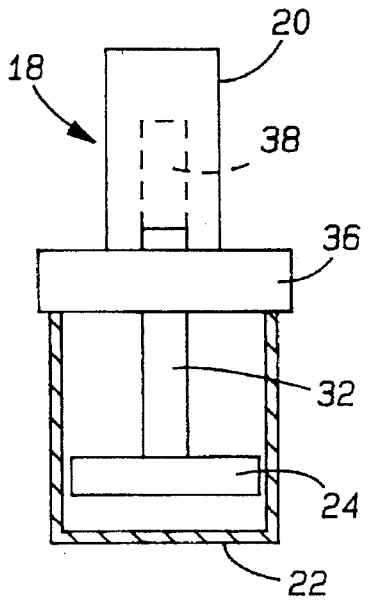
FIG. 9*a* shows an elevated sectional view of the intensifier of the present invention with no loss of oil.
Figure 9B:
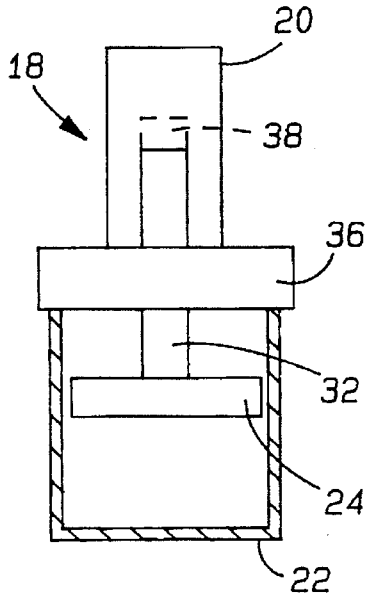
FIG. 9*b* is similar to the view of FIG. 9*a* but illustrating the intensifier as having lost some oil.

Another factor that will affect the true displacement of the air piston at the breakpoint is loss of hydraulic oil. If the tool loses oil, the air piston 24 will not return fully to its home position. FIG. 9*a* shows an elevated sectional view of the intensifier 18 of the present invention showing no loss of oil from the cavity 38. As may be seen, the air piston 24 is situated in its home position close to the base of the cylinder 22. Conversely, FIG. 9*b*, while similar to that of FIG. 9*a*, illustrates an intensifier 16 that has experienced a loss of some oil from the cavity 38. The loss of this oil results in the offsetting of the air piston 24 from its normal home position shown in FIG. 9*a* to a displaced position slightly further away from the end wall of the cylinder 22 shown in FIG. 9*b*.

Figure 10A:
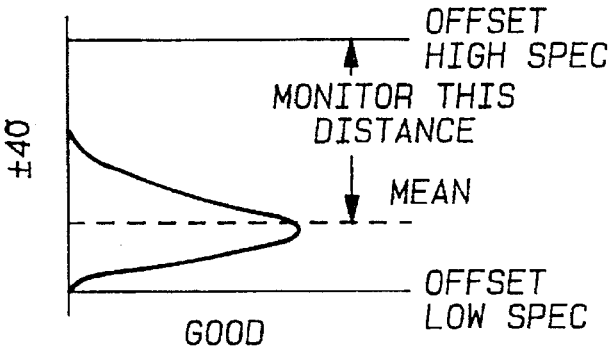
FIG. 10*a* shows a bell curve produced from an intensifier experiencing no air piston offset.
Figure 10B:
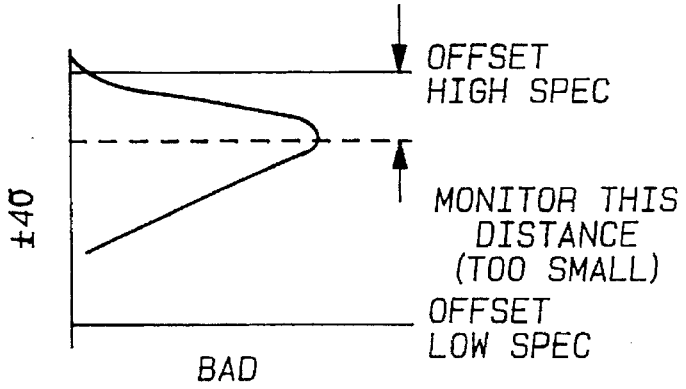
FIG. 10*b* shows a bell curve produced from an intensifier experiencing air piston offset.

When the tool looses enough oil, the stroke of the tool 12 is accordingly reduced, and the tool becomes inefficient by requiring more than one pull to set a rivet. Although the tool has a certain amount of oil reserve before the stroke is affected, the oil loss may be monitored by checking the displacement of the air piston 24, thus having the ability to predict failure before it occurs. Bell curves demonstrate differences in operation caused by loss of oil. FIG. 10*a* shows a bell curve produced from an intensifier experiencing no air piston offset. This is a correct and desirable bell curve. Conversely, FIG. 10*b* shows graphically a bell curve produced from an intensifier experiencing air piston offset thus resulting in an undesirable curve and, more importantly, an offset air piston 24.

Figure 11:
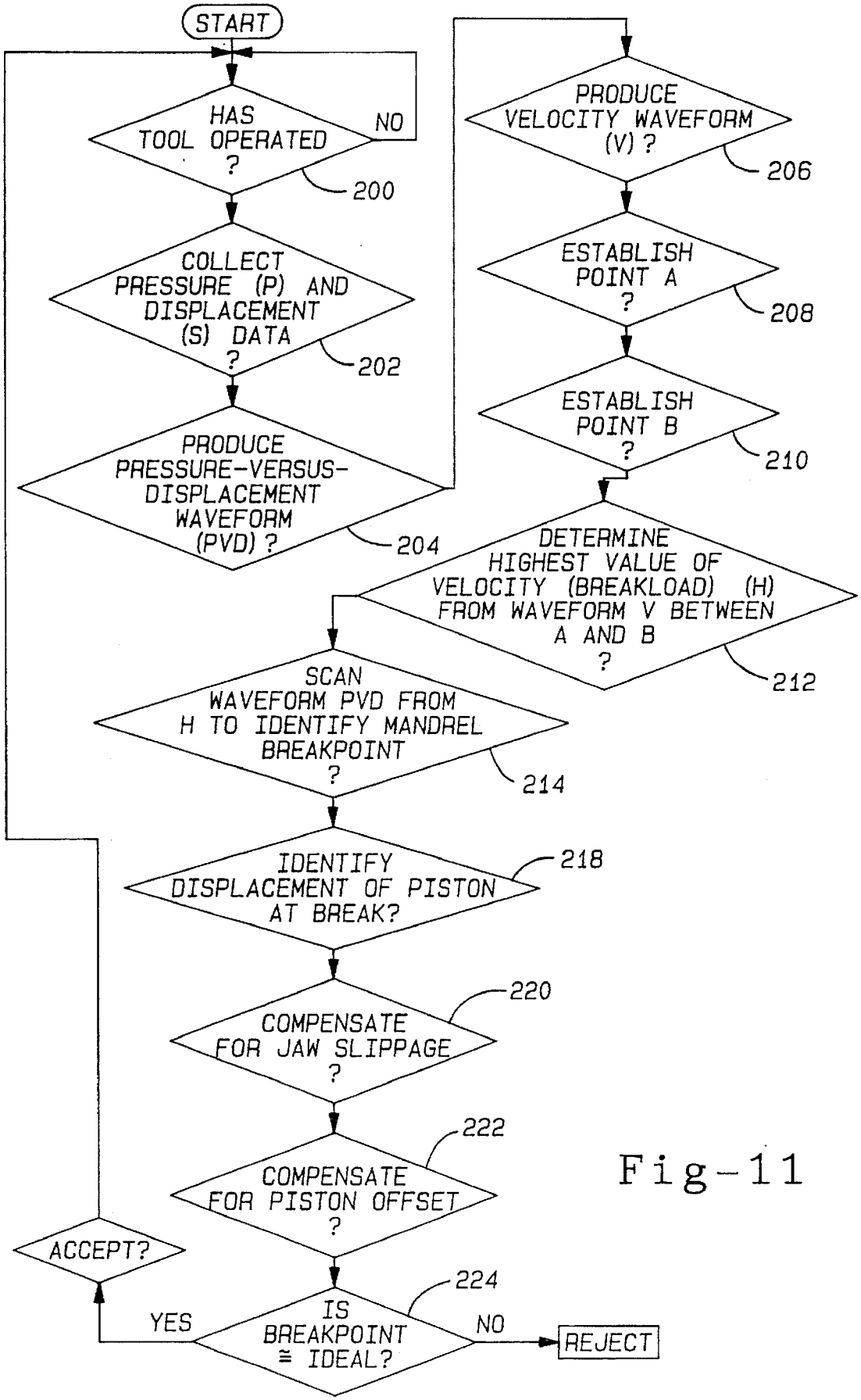
FIG. 11 is a control flowchart of illustrative undergrip-overgrip analysis steps in accordance with this invention.

The operations in the undergrip-overgrip analysis set forth above are managed by a programmed control algorithm included in the system control circuit 18. The undergrip-overgrip control algorithm used will now be described by reference to a flow chart shown in FIG. 11 in which an exemplary overall undergrip-overgrip operation flow of the present invention is set forth.

As with the breakload analysis set forth above, operation of the tool 12 is initiated via actuation of the trigger 46. After making an affirmative determination at the initial query at step 200 as to whether or not the tool has been operated, the algorithm collects the pressure (P) and displacement (S) data at Step 202 and, at Step 204, produces a pressure-versus-displacement waveform (PVD), all as set forth above with respect to breakload analysis. Also as with breakload analysis, a velocity waveform (V) is produced at Step 206, after which the algorithm moves forward to Step 208 to search for Point A and then to Step 210 to establish Point B. Once Points A and B are established, the algorithm moves to Step 212 to identify the location between Points A and B representing the greatest velocity value. At Step 214, the breakpoint is identified, again according to the previously discussed breakload analysis.

As noted above, because the pressure and displacement transducers are monitored sequentially, the location in the computer memory adjacent to the pressure peak breakpoint is identified as the total displacement of the piston 24 at breakpoint, and the algorithm moves to Step 218 to make this identification. Once breakpoint displacement of the piston 24 is established, the algorithm moves forward to Step 220 at which point compensation is made for jaw slippage by identifying periods of displacement when observed pressure values are below 300 pounds per square inch, and subtracting these displacement amounts from the overall displacement at break as set forth above. This step is repeated for each instance of jaw slippage. Compensation for jaw slippage completed, the algorithm moves forward to Step 222 at which point compensation for offset is made by determining the value of offset displacement and subtracting this value from the displacement at break, also as set forth above.

Compensation for slippage and offset completed, the algorithm moves forward to Step 224 to compare the value representing actual compensated displacement at break against a value representing ideal displacement at break. If at Step 224 it is determined that the value representing actual compensated displacement at break is not within a predetermined range of values of the ideal break, the set is rejected and the red light 120 is illuminated indicating to the operator that the set is unacceptable. On the other hand, if at Step 224 it is determined that the value of actual compensated displacement at break is acceptable, then the green "correct" light 116 is illuminated.

CLAMP ANALYSIS

Figure 12:
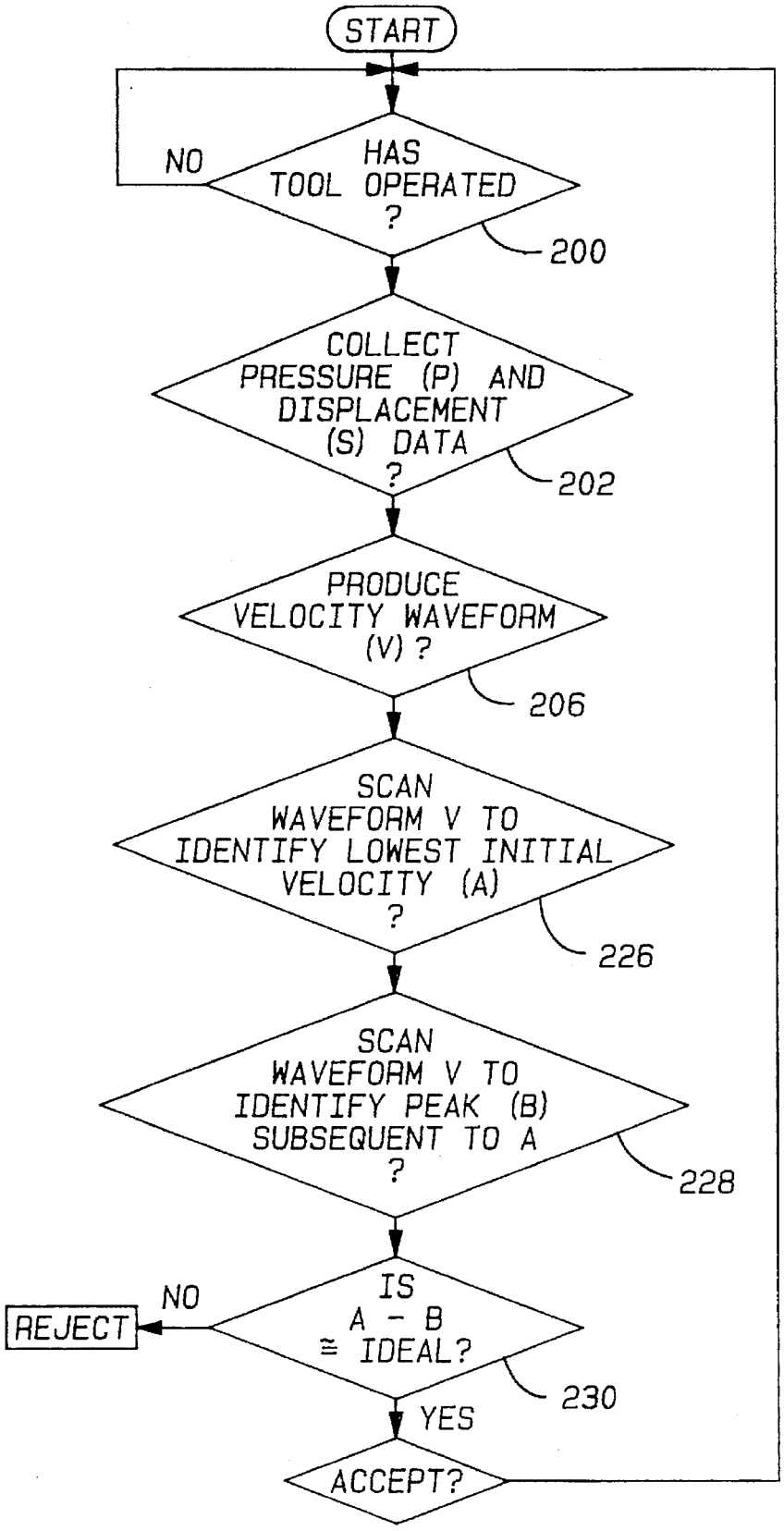
FIG. 12 is a control flowchart of illustrative clamp analysis steps in accordance with this invention.

If the rivet sleeve 76 is composed of a material that is too hard, or if the material of the mandrel 72 is composed of a material that is too soft, or if the crimp on the mandrel is not to specifications, the secondary clamp element may not pull all the way to the secondary side of the workpieces prior to breakage. There is also the possibility that the mandrel head may not even enter the rivet body. In either event, the result is a loose and undesirable set. The rivet set verification system of the present invention is adapted to monitor this condition by way of a programmed control algorithm to analyze the clamp condition. The control algorithm used to analyze the clamp is included in the control circuit 18 and is described by reference to a clamp analysis flow chart shown in FIG. 12 in which an exemplary operation flow of the clamp analysis is set forth.

Once operation of the tool 12 is confirmed at Step 200 and pressure (P) and displacement (S) data are collected at Step 202 as set forth above with respect to breakload analysis, the algorithm moves to Step 206 to produce a velocity waveform.

Figure 13:
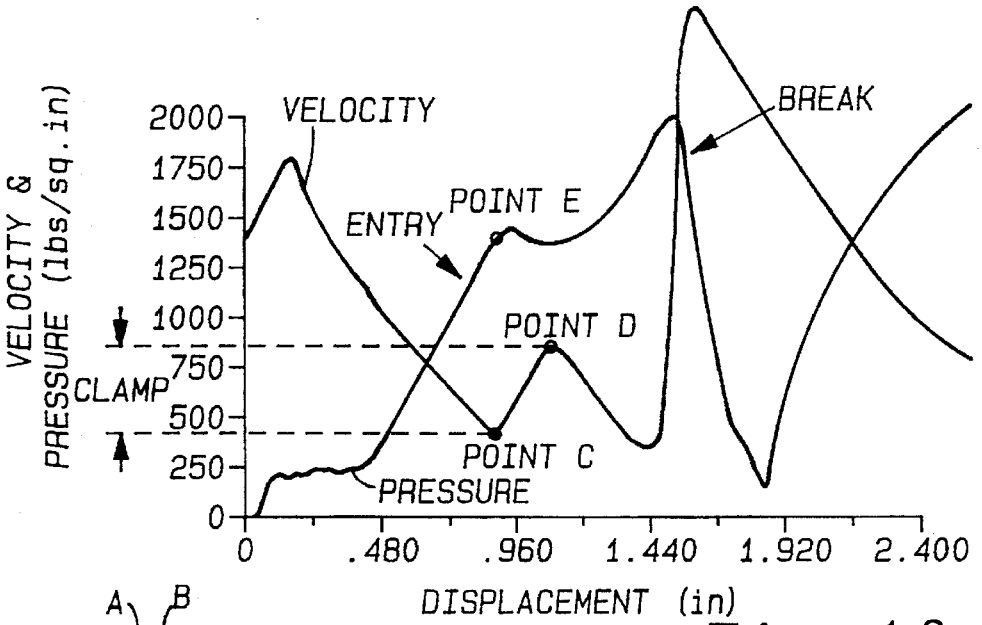
FIG. 13 shows a coordinate graph illustrating both a pressure-versus-displacement waveform and a velocity waveform for a rivet demonstrating a good clamp with displacement being measured along the X-axis and pressure measured along the Y-axis.
Figure 13A:
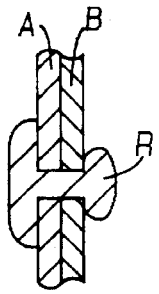
FIG. 13*a* is a sectional view of a workpiece comprising two plates held together by a rivet demonstrating good clamp characteristics.

The waveform produced at Step 226 graphically represents the analysis of the clamp. When the mandrel head enters the rivet body the velocity of the air piston 24 rises due to a drop in hydraulic pressure as the rivet body collapses. The algorithm moves forward to Step 226 to monitor this rise, which is graphically demonstrated in FIG. 13 as Point C. FIG. 13 shows a coordinate graph illustrating both a pressure-versus-displacement waveform (for comparison) and a velocity waveform for a rivet set. With the algorithm proceeding next to Step 228, the velocity waveform is monitored until Point D is found. Point D is the point where the mandrel head has reached the secondary side of the application. The difference between Point C and Point D determines whether secondary head formation or clamp is correct. The correctness of this difference is determined by using the comparator circuit which compares the value derived from the set with the predetermined desired value stored in the programmable reference 114. At Step 230, the difference between Points C and D (measured along the Y-axis) is determined, and this difference is compared against a predetermined range for an ideal difference. A correct set is illustrated in FIG. 13*a* which is a sectional view of a workpiece comprising two plates, labeled C and D, held together by a rivet R. With this correct set being identified at Step 232, the green light 116 is illuminated.

Figure 14:
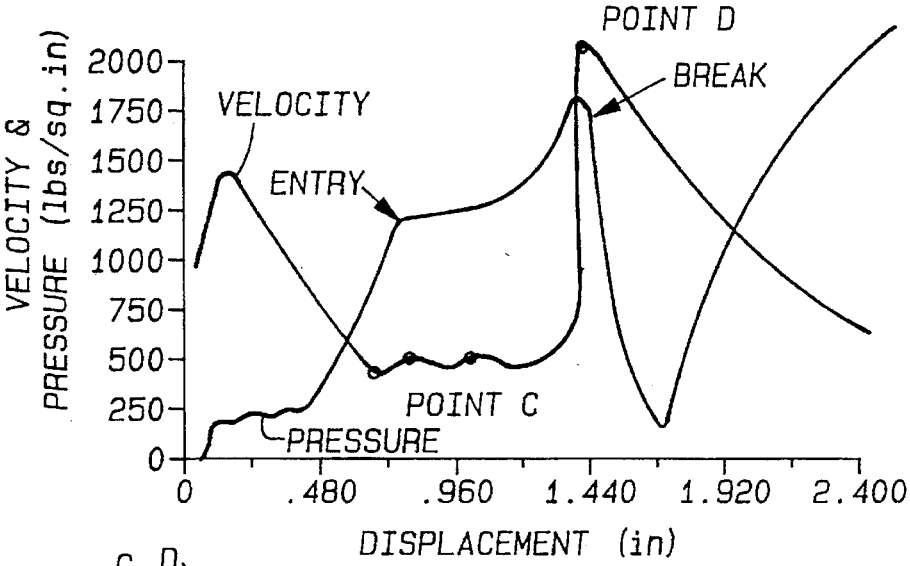
FIG. 14 is a graph similar to that of FIG. 13 but showing waveforms for a rivet demonstrating a bad clamp.
Figure 14A:
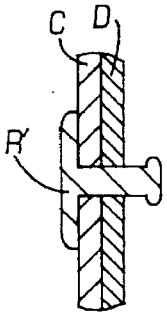
FIG. 14*a* is a sectional view of a workpiece similar to that of FIG. 13*a* but demonstrating bad clamp characteristics.

FIG. 14 is a graph similar to that of FIG. 13 but illustrating a waveform in which the difference between Points C and D is considerably less than that between Points C and D of FIG. 13. This small difference is not enough to constitute a good clamp situation. The resulting bad clamp is demonstrated in a sectional view in FIG. 14*a*, illustrating a rivet R' fastening together two plates, C and D. This type of bad clamp typically indicates an overgrip situation, as the air piston 24 did not move the specified distance at the breakpoint. The operator is apprised of the incorrect set by illumination of the red light 120.

ENTRY LOAD ANALYSIS

Figure 15:
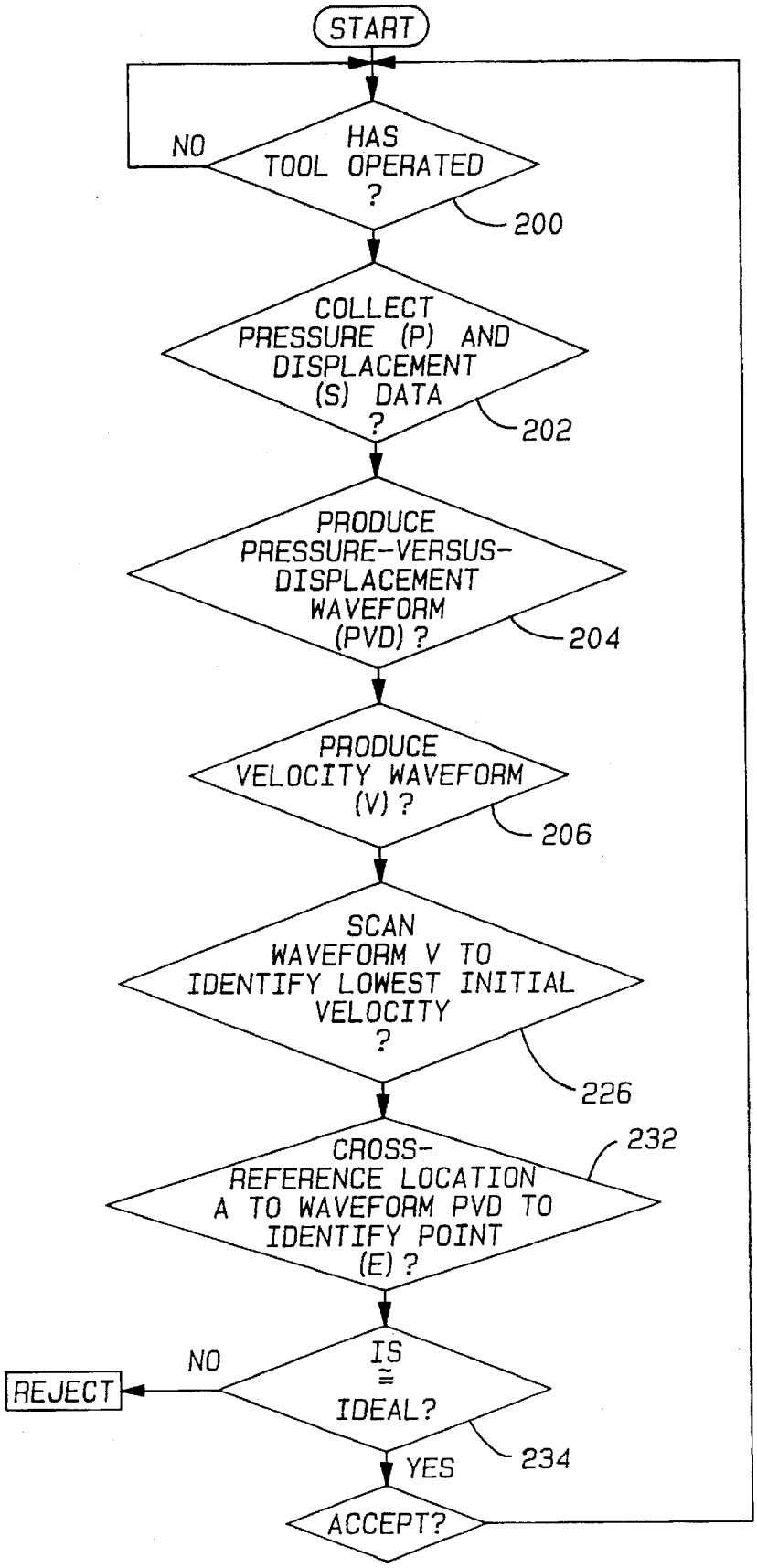
FIG. 15 is a control flowchart of illustrative entry load analysis steps in accordance with this invention.

If a rivet has a known specified entry load, the desirability of the load produced at the actual set can be compared against predetermined desirable values to determine the correctness of the set. The system control circuit 18 includes a programmed entry load analysis algorithm that is set forth in a flow chart shown in FIG. 15. As with the other analyses set forth above, Step 200 confirms that the tool 12 has, in fact, been operated, and once so confirmed, pressure (P) and displacement (S) data are collected at Step 202. As with the above-described breakload analysis, the algorithm proceeds forward to Step 204 to produce a pressure-versus-displacement waveform (PVD) and then next proceeds to Step 206 to produce a velocity waveform (V).

Thereafter the algorithm proceeds to Step 226 to scan the velocity waveform to find Point C in FIG. 13. Once point C is identified, the algorithm moves onto Step 232 which cross-references the location of Point C to identify a Point E on the pressure-versus-displacement waveform that is equidistant from the Y-axis, or the load-pressure axis. The cross-referenced value at Point E is then converted to a load in pounds. The algorithm next moves to Step 234 to compare the converted value against the predetermined preferred entry load value. As with the previously discussed analyses, if the actual entry load is not within the predetermined preferred entry load range, the set is rejected and the red light 120 is illuminated indicating to the operator that the set is unacceptable. Conversely, if the set is within the acceptable range, the green "correct" light 116 is illuminated.

PULL-THROUGH ANALYSIS

Instead of clamping the pieces together, occasionally the secondary rivet head is formed but does not hold the pieces together but is rather simply pulled through the aperture within which the tubular body is provided for clamping. A pull-through situation occurs typically because either the hole size is too large, the rivet body material is too soft, the mandrel crimp is not in the correct location, the grip is out of the acceptable range as known, or the mandrel crimp breakload is too high. (The latter situation arises where the mandrel material is too hard or is incorrectly heat treated, or if the tubular body is too shallow to crimp.) A visual indication of a pull-through situation would reveal part of the mandrel protruding from the rivet body after the rivet is set. If any of these conditions arise, the entry load will probably be too low and an undergrip situation will occur. The operator is so notified after entry load and undergrip-overgrip analyses are made as set forth above.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a hydraulically operated blind rivet setting tool, said tool including a rivet engaging assembly for engaging said stem of said mandrel and an axially movable piston assembly operatively coupled to said rivet engaging assembly for driving said mandrel in response to the application of pressurized hydraulic fluid to said piston assembly;

a first transducer for monitoring the pressure of the hydraulic fluid applied to said, piston assembly during a rivet setting process and producing pressure output signals related thereto;

a second transducer operatively associated with said tool for producing displacement output signals related to the movement of said piston assembly in the axial direction during the rivet setting process; and a control circuit, said control circuit having circuitry to:

(a) receive a series of said pressure output signals and a series of said displacement output signals during the rivet setting process;

(b) determine from said series of displacement output signals the velocity of said piston assembly during the rivet setting process;

(c) identify the occurrence during the rivet setting process of the highest value of velocity;

(d) use the occurrence of the highest value of velocity to identify the mandrel breakpoint; and (e) compare a breakpoint load value determined from the value of the pressure output signal at the mandrel breakpoint with a predetermined desired value.

2. The system for setting a blind rivet of claim 1 wherein said control circuit further includes circuitry to:

produce from said series of pressure output signals and said series of displacement output signals received over the rivet setting process a pressure-versus-displacement waveform and a velocity waveform;

scan said velocity waveform to determine the location in the velocity waveform of the highest value of velocity; and use the determined location of the highest value of velocity to scan said pressure-versus-displacement waveform to identify the mandrel breakpoint.

3. The system of claim 1 further including a hydraulic intensifier assembly and a hydraulic line fluidly connecting said hydraulic intensifier assembly to said piston assembly of said rivet setting tool, said hydraulic intensifier assembly including a second axially movable piston assembly; and further wherein said first and second transducers are operatively coupled to said hydraulic intensifier assembly.

4. The system for setting a blind rivet of claim 1 further including an indicator operatively connected to said control circuit for signalling to an operator the acceptability of the set based on said comparison of said breakpoint load value against said predetermined desired value.

5. The system of claim 1 wherein said first transducer is an electrical pressure transducer and wherein said second transducer is a linear variable differential transformer.

6. The system of claim 1 wherein said control circuit includes an integrator, a comparator connected with said integrator, and a programmable memory connected with said comparator.

7. A method of setting a blind rivet having a mandrel with a setting tool having a mandrel engaging assembly for engaging said mandrel and an axially movable piston assembly operatively coupled to said engaging assembly for driving said mandrel in response to the application of pressurized hydraulic fluid to said piston assembly; said method including the steps of:

(a) monitoring the pressure of the hydraulic fluid applied to said piston assembly during a rivet setting process and producing a series of pressure signals related thereto;

(b) monitoring the movement of said piston assembly in the axial direction during said rivet setting process and producing a series of displacement signals related thereto;

(c) determining from said series of displacement signals the velocity of said piston assembly during the rivet setting process;

(d) identifying the occurrence during the rivet setting process of the highest value of velocity;

(e) using the occurrence of the highest value of velocity to identify the mandrel breakpoint;

(f) comparing a breakpoint load value determined from the value of the pressure signal at the mandrel breakpoint with a predetermined desired value.

8. The method of claim 7 further including the steps of:

producing a pressure-versus-displacement waveform based on said series of pressure signals and said series of displacement signals produced over the rivet setting process;

producing a velocity waveform based on said series of displacement signals;

scanning said velocity waveform to determine the point in time during the rivet setting process when the highest value of velocity occurred;

using said determined point in time to scan said pressure-versus-displacement waveform to identify the mandrel breakpoint.

9. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a hydraulically operated blind rivet setting tool, said tool including a rivet engaging assembly for engaging said stem of said mandrel and an axially movable piston assembly operatively coupled to said rivet engaging assembly for driving said mandrel in response to the application of pressurized hydraulic fluid to said piston assembly;

a first transducer for monitoring the pressure of the hydraulic fluid applied to said piston assembly during a rivet setting process and producing pressure output signals related thereto;

a second transducer operatively associated with said tool for producing displacement output signals related to the movement of said piston assembly in the axial direction during the rivet setting process; and a control circuit, said control circuit having circuitry to:

(a) receive a series of said pressure output signals and a series of said displacement output signals during the rivet setting process;

(b) identify the occurrence during the rivet setting process of the peak pressure;

(c) use the occurrence of the pressure peak to identify the break of the mandrel;

(d) determine the total displacement of said piston assembly at the break of the mandrel; and (e) compare said total displacement with a predetermined desired value.

10. The system for setting a blind rivet of claim 9 wherein said control circuit further includes circuitry to:

produce from said series of pressure output signals and said series of displacement output signals received over the rivet setting process a pressure-versus-displacement waveform;

scan said pressure-versus-displacement waveform to identify the location of the pressure peak in the waveform;

use the identified location of the pressure peak to identify the break of the mandrel; and determine from said waveform the total displacement of said piston assembly at the break of the mandrel.

11. The system for setting a blind rivet of claim 10 wherein said control circuit further includes circuitry for scanning said pressure-versus-displacement waveform for slippage of said mandrel within said rivet engaging assembly by scanning said waveform for a drop in pressure, determining a first displacement value from the point on said waveform where said drop in pressure occurs, scanning said waveform for a subsequent rise in pressure, determining a second displacement value from the point on said waveform where said rise in pressure occurs, determining the difference between said first and second displacement values, and subtracting said difference from said total displacement.

12. The system for setting a blind rivet of claim 11 wherein said control circuit further includes circuitry for scanning said pressure-versus-displacement waveform for all occurrences of slippage and subtracting the amount of displacement determined for each slippage occurrence from said total displacement.

13. The system for setting a blind rivet of claim 10 wherein said control circuit further includes circuitry for identifying the value any offset of said piston assembly between sets of rivets and for subtracting said identified offset value from said total displacement.

14. The system for setting a blind rivet of claim 9 further including an indicator operatively connected to said control circuit for signalling to an operator the acceptability of the rivet set based on said comparison of said total displacement to said predetermined desired value.

15. The system of claim 9 further including a hydraulic intensifier assembly and a hydraulic line fluidly connecting said hydraulic intensifier assembly to said piston assembly of said rivet setting tool, said hydraulic intensifier assembly including a second axially movable piston assembly; and further wherein said first and second transducers are operatively coupled to said hydraulic intensifier assembly.

16. The system for setting a blind rivet of claim 15 wherein said first transducer is an electrical pressure transducer and wherein said second transducer is a linear variable differential transformer.

17. A method of setting a blind rivet having a mandrel with a setting tool having a mandrel engaging assembly for engaging said mandrel and an axially movable piston assembly operatively coupled to said engaging assembly for driving said mandrel in response to the application of pressurized hydraulic fluid to said piston assembly; said method including the steps of:

(a) monitoring the pressure of the hydraulic fluid applied to said piston assembly during a rivet setting process and producing a series of pressure signals related thereto;

(b) monitoring the movement of said piston assembly in the axial direction during said rivet setting process and producing a series of displacement signals related thereto;

(c) identifying the occurrence during the rivet setting process of a peak pressure;

(d) using the occurrence of the peak pressure to identify the breakpoint of the mandrel;

(e) determining the total displacement of the piston assembly at the mandrel breakpoint; and (f) comparing the total displacement with a predetermined desired value.

18. The method of claim 17 further including the steps of:

producing a pressure-versus-displacement waveform based on said series of pressure signals and said series of displacement signals produced over the rivet setting process;

scanning said pressure-versus-displacement waveform to identify the location of a pressure peak in said waveform;

using the location of the pressure peak to identify the total displacement of the piston assembly at the breakpoint of the mandrel.

19. The method for setting a blind rivet according to claim 18 including the additional steps of:

scanning said pressure-versus-displacement waveform for slippage of said mandrel within said jaw assembly by scanning said waveform for a drop in pressure;

determining a first displacement value from the point on said waveform where said drop in pressure occurs;

scanning said waveform for a subsequent rise in pressure;

determining a second displacement value from the point on the waveform where said rise in pressure occurs;

determining the difference between said first and second displacement values; and subtracting said difference from said total displacement.

20. The method for setting a blind rivet according to claim 19 including the additional steps of:

scanning said pressure-versus-displacement waveform for all occurrences of slippage; and subtracting the amount of displacement determined for each slippage occurrence from said total displacement.

21. The method for setting a blind rivet according to claim 18 including the additional steps of:

noting the occurrence of piston offset between sets of rivet sets;

assigning an offset value representing the amount of offset at said piston offset occurrence; and subtracting said offset value from said total displacement.

22. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a hydraulically operated blind rivet setting tool, said tool including a rivet engaging assembly for engaging said stem of said mandrel and an axially movable piston assembly operatively coupled to said rivet engaging assembly for driving said mandrel in response to the application of pressurized hydraulic fluid to said piston assembly;

a transducer operatively associated with said tool for producing displacement output signals related to the movement of said piston assembly in the axial direction during the rivet setting process; and a control circuit, said control circuit having circuitry to:

(a) receive a series of said displacement output signals over time;

(b) determine from said series of displacement output signals the velocity of said piston assembly during the rivet setting process;

(c) determine a lowest initial velocity value;

(d) determine a peak velocity value subsequent to said lowest initial velocity value;

(e) determine the difference between said lowest initial velocity value and said peak velocity value; and (f) compare the determined difference with a predetermined desired value.

23. The system of claim 22 wherein the circuitry for determining the velocity of said piston assembly measures the intervals between receipt of successive displacement output signals.

24. The system of claim 22 wherein said control circuit further includes circuitry to:

produce from said displacement output signals a velocity waveform;

scan said velocity waveform to determine the lowest initial value of velocity;

scan said velocity waveform to determine a peak of said waveform subsequent to said lowest initial value of velocity; and determine the difference between said lowest initial value and said subsequent peak.

25. The system for setting a blind rivet of claim 22 further including an indicator operatively connected to said control circuit for signalling to an operator the acceptability of the set based on said comparison of said actual determined difference against said predetermined desired value.

26. The system of claim 22 further including a hydraulic intensifier assembly and a hydraulic line fluidly connecting said hydraulic intensifier assembly to said piston assembly of said rivet setting tool, said hydraulic intensifier assembly including a second axially movable piston assembly; and further wherein said first and second transducers are operatively coupled to said hydraulic intensifier assembly.

27. The system for setting a blind rivet of claim 26 wherein said transducer is a linear variable differential transformer.

28. A method of setting a blind rivet having a mandrel with a setting tool having a mandrel engaging assembly for engaging said mandrel and an axially movable piston assembly operatively coupled to said engaging assembly for driving said mandrel in response to the application of pressurized hydraulic fluid to said piston assembly; said method including the steps of:

(a) monitoring the movement of said piston assembly in the axial direction during the rivet setting process and producing a series of displacement signals;

(b) determining from said series of displacement signals the velocity of said piston assembly;

(c) determining a lowest initial value of velocity;

(d) determining a peak velocity value subsequent to said lowest initial velocity value;

(e) determining the difference between said lowest initial velocity value and said peak velocity value; and (f) comparing said difference to a predetermined desired value.

29. The method of claim 28 wherein said step of determining the velocity of said piston assembly includes measuring the intervals between successive displacement signals in said series.

30. The method of claim 28 further including the steps of:

determining from said series of displacement signals a velocity waveform;

scanning said velocity waveform to determine a lowest initial value of velocity; and scanning said velocity waveform to determine a peak in said waveform subsequent to said lowest initial value of velocity.

31. A system for setting a blind rivet and evaluating the acceptability of the set, said rivet being of the type having a frangible tubular body and an elongated mandrel that includes an enlarged head and a stem extending rearwardly of the head and through said frangible tubular body, said system comprising:

a hydraulically operated blind rivet setting tool, said tool including a rivet engaging assembly for engaging said stem of said mandrel and an axially movable piston assembly operatively coupled to said rivet engaging assembly for driving said mandrel in response to the application of pressurized hydraulic fluid to said piston assembly;

a first transducer for monitoring the pressure of the hydraulic fluid applied to said piston assembly during a rivet setting process and producing pressure output signals related thereto;

a second transducer operatively associated with said tool for producing displacement output signals related to the movement of said piston assembly in the axial direction during the rivet setting process; and a control circuit, said control circuit having circuitry to:

(a) receive a series of said pressure output signals and a series of said displacement output signals;

(b) determine from said series of displacement output signals the velocity of said piston assembly during the rivet setting process;

(c) determine the occurrence of a lowest initial value of velocity, this value representing the point in time during the rivet setting process when the mandrel head enters the rivet body;

(d) determine the value of the pressure output signal at said point in time when the mandrel head enters the rivet body; and (e) compare said pressure value with a predetermined desired value.

32. The system of claim 31 wherein said control circuit further includes circuitry to:

produce from said series of pressure output signals and said series of displacement output signals a pressure-versus-displacement waveform and a velocity waveform;

determine the point on said velocity waveform of a lowest initial velocity value; and determine the pressure value at the corresponding point on said pressure-versus-displacement waveform.

33. The system for setting a blind rivet of claim 31 further including an indicator operatively connected to said control circuit for signalling to an operator the acceptability of the set based on said comparison of said pressure value with said predetermined desired value.

34. The system of claim 31 further including a hydraulic intensifier assembly and a hydraulic line fluidly connecting said hydraulic intensifier assembly to said piston assembly of said rivet setting tool, said hydraulic intensifier assembly including a second axially movable piston assembly; and further wherein said first and second transducers are operatively coupled to said hydraulic intensifier assembly.

35. The system for setting a blind rivet of claim 34 wherein said first transducer is an electrical pressure transducer and wherein said second transducer is a linear variable differential transformer.

36. A method of setting a blind rivet having a tubular body and a mandrel with an enlarged head portion and an elongated stem portion extending through said body, with a setting tool having a mandrel engaging assembly for engaging said mandrel and an axially movable piston assembly operatively coupled to said engaging assembly for driving said mandrel in response to the application of pressurized hydraulic fluid to said piston assembly; said method including the steps of:

(a) monitoring the pressure of the hydraulic fluid applied to said piston assembly during a rivet setting process and producing a series of pressure signals related thereto;

(b) monitoring the movement of said piston assembly in the axial direction during said rivet setting process and producing a series of displacement signals related thereto;

(c) determining from said series of displacement signals the velocity of said piston assembly during the rivet setting process;

(d) determining the occurrence of a lowest initial velocity value, said lowest initial velocity value representing the point in time during the rivet setting process when the mandrel head enters the rivet body;

(e) determining the value of said pressure output signal at said point in time when the mandrel head enters the rivet body; and (f) comparing said pressure value to a predetermined desired value.

37. The method of claim 36 further including the steps of:

producing a pressure-versus-displacement waveform based on said series of pressure signals and said series of displacement signals;

producing a velocity waveform based on said series of displacement signals over time;

determining the point on said velocity waveform of the lowest initial velocity value, this value representing the point at which the mandrel head enters the rivet body; and determining the pressure value at the corresponding point on said pressure-versus-displacement waveform.

* * * * *